US005584909A

United States Patent [19]

Kim

[11] Patent Number: 5,584,909

[45] Date of Patent: Dec. 17, 1996

[54] CONTROLLED FOAMY SLAG PROCESS

[75] Inventor: Chung S. Kim, Hudson, Ohio

[73] Assignee: LTV Steel Company, Inc., Cleveland, Ohio

[21] Appl. No.: 375,343

[22] Filed: Jan. 19, 1995

[51] Int. Cl.[6] ..... C21C 5/32

[52] U.S. Cl. ..... 75/387; 75/553

[58] Field of Search ..... 75/387, 501, 502, 75/553

[56] References Cited

U.S. PATENT DOCUMENTS

| | | | |
|---|---|---|---|
| 3,356,490 | 12/1967 | Muller et al. . | |
| 3,773,495 | 11/1973 | Nilles et al. . | |
| 3,871,871 | 3/1975 | Denis et al. . | |
| 3,997,335 | 12/1976 | Kolb et al. . | |
| 4,201,572 | 5/1980 | Slammar . | |
| 4,345,746 | 8/1982 | Schleimer et al. | 75/375 |
| 4,349,382 | 9/1982 | Schleimer et al. . | |
| 4,398,948 | 8/1983 | Emoto et al. . | |
| 4,473,397 | 9/1984 | Bleeck et al. . | |

FOREIGN PATENT DOCUMENTS

| | | |
|---|---|---|
| 2149023 | 1/1974 | Germany . |
| 2326706 | 12/1974 | Germany . |
| 5043924 | 6/1993 | Japan . |

OTHER PUBLICATIONS

*Steelmaking Proceedings*, R. G. Blossey, C. S. Kim and J. D. Shimkets; BOF Slopping Control, vol. 62, 1979 (Detroit) pp. 158–163.

*On Some Aspects of Supersonic Jets of Interest in LD Steelmaking* A. Chatterjee, Dec. 1972, Part 1.

*On Some Aspect of Supersonic Jets of Interest in LD Steelmaking*, A. Chatterjee, Feb. 1973, Part 2.

*Primary Examiner*—Melvyn Andrews
*Attorney, Agent, or Firm*—Watts Hoffmann Fisher & Heinke

[57] ABSTRACT

A method of improving the post-combustion heat recovery in a basic oxygen furnace by controllably forming a foamy slag. The foamy slag is generated by increasing the lance height and reducing the rate of lance height reduction during the oxygen blowing cycle. The foamy slag is controlled to prevent slopping by calculating the approximate starting point of the peak decarburization period for the charge and then adjusting the oxygen flow rate to be at a minimum at the commencement of the peak decarburization period.

13 Claims, No Drawings

CONTROLLED FOAMY SLAG PROCESS

BACKGROUND OF THE INVENTION

Basic Oxygen Furnace (BOF) steelmaking produces, among other things, large amounts of carbon monoxide (CO) gas above the molten metal bath. This so called "off-gas" contains more potential heat than the total heat generated in the steel/slag bath by oxidation reactions. If this so called "post-combustion" heat, generated by the burning of CO to $CO_2$ above the bath, can be recaptured by the steel bath, significant energy and cost savings can be achieved. By effectively recapturing the post-combustion heat larger amounts of scrap can be charged to the heat, which would result in higher steel production yields in hot-metal-limited BOF shops. Similarly, it would enable the refining of lower cost iron ore to decrease BOF steel costs in hot-metal-rich BOF shops. Unfortunately, with current BOF practices most of the potential heat energy from the off-gas is wasted due to inefficient heat transfer between the gas and the bath. Previous attempts to capture the post-combustion energy within the BOF vessel have typically resulted in premature vessel lining failure.

In addition to the various off-gases, many BOF steelmaking practices also have the tendency to generate a foamy slag. While a small amount of foamy slag can have beneficial effects on the metallurgical reactions in the BOF, foamy slag is, by its nature, potentially hazardous and generally avoided. When large amounts of foam are produced, slopping of the foam from the BOF vessel can become uncontrollable, causing yield loss as well as environmental and safety hazards. As a result, there have been many efforts made to control or minimize the production of foamy slag.

Despite the numerous problems associated with foamy slag, it has nevertheless been found that it can provide a good heat transfer medium between the post-combustion heat generated by the combustion of CO to $CO_2$ and the metal bath. Accordingly, the present invention relates to a BOF blowing practice to be used to intentionally make foamy slag in a controllable, environmentally acceptable manner to enhance post-combustion heat recovery.

DISCLOSURE OF THE INVENTION

In accordance with the present invention there is provided a technique for making foamy slag in a controlled manner such that it poses no risk of yield loss or environmental compliance and safety violations. As a result of the intentional, but controlled formation of foamy slag, significant improvements in the heat transfer between the post-combustion gas and the melt are obtained. This has enabled the use of larger amounts of scrap in the molten charge, resulting in significant increases in steel production. Moreover, the intentional production of foamy slag has led to improved phosphorus removal, resulting in large reductions in flux consumption and the associated cost thereof. Still further, the inventive method not only has no adverse effect on the BOF vessel lining, it actually extends the life of the vessel refractory linings. The inventive process also generates significantly less iron dust. Thus, the process of the invention can be used to significantly improve any BOF practice resulting in increased yields, reduced raw material costs, extend vessel lining life and improved environmental conditions.

The inventive method resides in using higher lance positions, and/or slower lance height reductions, to intentionally create and maintain a foamy slag, coupled with significant, timely reductions in the oxygen flow rate to control slopping. It has been observed that dangerous slopping is typically associated with the commencement of the peak decarburization period for a given charge. Thus, if the oxygen flow rate is timely adjusted to be at a minimum at or slightly before the commencement of the peak decarburization period for a given charge, then slopping of the foam can be controlled. This is accomplished by calculating the oxygen volume necessary to reach the peak decarburization period for a given charge, and then timing the flow rate reduction to reach a minimum at that point in the blowing cycle. This timing is critical because it has been observed that once slopping starts, it is too late to adjust the blowing parameters to avoid the hazards and yield losses associated therewith. Importantly, the ability to controllably create foamy slag in this manner is based on the applicant's discovery that, if appropriately timed, the oxygen flow rate can be significantly reduced, as much as 30% below lance specifications, without adversely effecting the oxygen utilization efficiency and hence, the ability to make steel. In this way, one can create the maximum amount of foamy slag using the high lance practice without loss of control and its associated dangers.

The lance height is defined as the distance from the lance tip to the quiescent liquid steel bath. The higher the lance position from the bath, the more FeO is produced in the slag which, coupled with a low V-ratio, i.e., the ratio of CaO to $SiO_2$ in the slag, will produce a highly foamy slag during the early stages of the blowing cycle. Reducing the lance height step-wise at a much slower pace then enhances and maintains the foaminess of the slag. The corresponding step-wise reduction in the oxygen flow rate controls the slag and prevents slopping. Although flow rate reduction also contributes to the formation and maintenance of the foamy slag, it is primarily responsible for slopping control.

The optimum parameters for starting lance height, lance height reduction, and oxygen flow rate reduction for each BOF shop will vary and must be determined based on prescribed shop operating parameters, vessel size and configuration, vessel age, hot metal chemistries and weight, heat size, aim carbon and empirical observations for each shop. However, for a given BOF practice, the inventive method is characterized by a higher starting lance height and/or slower lance height reduction rate than would normally be used, to intentionally produce a foamy slag, coupled with a large reduction in the oxygen flow rate that is adjusted to be at a minimum at the peak decarburization period for a given melt. Given these inventive parameters, those of ordinary skill in the art will be able to make the necessary adjustments and modifications to the prescribed shop practice to obtain the optimum starting lance height, lance height reduction schedule and flow rate reduction schedule for a given BOF based on empirical observation and the instant disclosure.

In accordance with the foregoing, the invention provides a method of improving post-combustion heat recovery in a vessel containing a charge of molten ferrous metal. In a preferred embodiment of the method the volume of oxygen to be blown to reach the starting point of the peak decarburization period is approximated and the lance is positioned to a height above the charge adapted to enable the oxygen to react with the charge to form a slag containing FeO in an amount effective to render the slag of a foamy consistency. Oxygen is blown on the charge at an initial oxygen flow rate effective to produce a foamy slag and then the height of said lance and the oxygen flow rate are decreased to produce foamy slag in an amount effective to obtain a post-combustion heat transfer efficiency of at least about 35% without slopping, the oxygen flow rate being reduced to a minimum at about the starting point of said peak decarburization period.

Preferably, the minimum oxygen flow rate is about 15 to about 30% lower than the lance specification for oxygen flow rate. Still more preferably, the minimum oxygen flow rate is about 20 to about 30% lower than the lance specification. In a prefered embodiment, the foamy slag is produced in an amount effective to produce a heat transfer efficiency of at least about 60%. Preferably, the height of the lance and the oxygen flow rate are first reduced after about 40 to about 60% of the oxygen volume required to reach the peak decarburization period is blown. Still more preferably, the oxygen flow rate is increased prior to the end of said peak decarburization period. In another embodiment, after said peak decarburization has commenced, the oxygen flow rate is increased to about the lance specification.

In a prefered aspect of the invention the FeO in the foamy slag is from about 14 to about 20% by weight based on the weight of the slag at the starting point of the peak decarburization period. More preferably, the FeO in the foamy slag is at least about 16% by weight based on the weight of the slag at the starting point of said the decarburization period.

Many additional features, advantages and a fuller understanding of the invention will be had from the following detailed description of preferred embodiments.

DETAILED DESCRIPTION OF THE PREFERRED EMBODIMENTS

Enhanced heat transfer efficiency from the post-combustion of off-gases to the molten metal charge is obtained according to the invention by intentionally forming a foamy slag, but in a controlled manner to prevent slopping. The ability to controllably produce a large amount of foamy slag is based on the applicant's discovery that, with proper timing, the oxygen flow rate can be surprisingly reduced as much as 30% below lance specifications without jeopardizing the oxygen utilization efficiency and ability to make steel.

The two principal means of making the slag foamy are to start with a higher lance, and to bring the lance down slower, preferably step-wise. While not wanting to be bound by theory, it is believed that this is because the higher lance positions and slower lance height reduction rate allows the oxygen to efficiently react with the iron in the charge to form FeO in the slag. It has been observed that a high FeO content, coupled with a low V-ratio, is conducive to foam formation. The higher the lance and the slower the height reduction the better for producing foam. However, the practice must stay within tolerable limits from the standpoint of controlling slopping and maintaining the oxygen utilization efficiency of the BOF blowing cycle in order to make steel.

Each BOF shop has specified operating parameters for the oxygen blowing cycle establishing starting lance height, lance height reduction rate, oxygen flow rate and the like, which typically vary from shop to shop. In the practice of the invention, the lance is initially adjusted to a height above the bath that is effective to create a foamy slag during the initial phase of the oxygen blowing cycle. This initial lance height is preferably higher than the normal shop specification. Once the slag is made foamy during the initial stage of the oxygen blowing cycle, the lance height is slowly reduced to further enhance and maintain the foam until the peak decarburization period of the blowing cycle.

In order to control the foamy slag produced by the high lance practice it is necessary to significantly reduce the oxygen flow rate at the appropriate time during the oxygen blowing cycle. At the same time, one must maintain an oxygen utilization efficiency sufficient to make steel. By ensuring that the oxygen flow rate is at its minimum at or about the commencement of the peak decarburization period of the blowing cycle, one can reduce the oxygen flow rate enough to controllably produce a sufficient amount of foamy slag to obtain post-combustion heat transfer efficiencies on the order of 80%, without jeopardizing the oxygen utilization efficiency. In order to accomplish this it is necessary to predict the peak decarburization period for a given charge since, as noted, the critical slopping period typically corresponds to the peak decarburization period. Once calculated, the oxygen flow rate can be scheduled to reach its minimum at the commencement of the peak decarburization period.

The peak decarburization period starts when essentially all of the silicon in the charge is oxidized. Until that point some carbon is burned, FeO is formed, a large amount of Mn is burned, and other elements such as Ti and Phosphorus are burned. The oxygen needed to reach the peak decarburization period is approximately equal to the amount of oxygen needed to oxidize these elements. Although some of these amounts are known, others are empirically calculated because the elements are only partially oxidized. From a sampling of the hot-metal being charged to the BOF vessel, the following formula can be used to approximate the oxygen volume in standard cubic feet (scf) necessary to reach the peak decarburization period for that charge.

$$(I)\ Oxygen\ (scf)=O_{Si}+O_{Fe}+O_{C}+O_{Mn}+O_{misc.}$$

In the above formula I, $O_{Si}$ stands for the amount of oxygen needed to remove silicon from the charge, which is in turn approximately equal to 13.85 times the total weight (pounds) of silicon or 13.85(wt. Si). The value 13.85 is a theoretical stoichiometric value for the volume of oxygen needed per pound of silicon. The total weight of silicon is contributed mostly from the hot metal, with some being contributed by silicon containing metallics such as cold iron, pig iron and the like. Thus, the value of (wt. Si) in the above calculation is derived from the relation 0.01(% hot metal Si)(weight of hot metal)+0.01(% Si in pig iron)(weight of pig iron).

The value of $O_{Fe}$ is the volume of oxygen needed to oxidize Fe to FeO and is approximately equal to equation (1) below:

$$(1)\ O_{Fe}=2.71(\text{weight FeO})$$

The value of 2.71 is again a stoichiometric value based on the volume of oxygen needed to form each pound of FeO. The weight of the FeO must be determined empirically. The weight of FeO is given by equation (2) below:

$$(2)\ \text{wt. FeO}=(0.01)(\%\text{FeO})(\text{wt. of slag})$$

The weight of the slag is approximately equal to the weight of $SiO_2$+weight of CaO+weight of FeO. The weight of $SiO_2$=2.14(wt. Si) and weight of CaO=VR(wt. $SiO_2$). Studies have indicated that the peak decarburization is also associated with a composition favoring dicalcium silicate formation, thus the value of the so called "V-ratio" or "basicity ratio" (VR), which is the ratio of %CaO to %$SiO_2$, is set to be approximately equal to 2.0. Thus, the weight of the slag is approximated by equation (3) as follows:

$$(3)\ (wt.\ slag.)=[(wt.\ SiO_2)+(wt.\ CaO)]/[0.01(100-\%FeO)]$$

Thus, combining equations (2) and (3) one approximates the weight of FeO as set forth in equation (4):

$$(4)\ (wt.\ FeO)=(\%FeO)[2.14(wt.\ Si)+2(2.14)(wt.\ Si)]/(100-\%FeO)$$

Studies have shown that the %FeO is typically on the order of about 12 to about 18% by weight based on the weight of the slag, depending on lance height and vessel geometry. The specific value to substitute in the foregoing equation is determined emperically and is preferably between about 16 to 18% since it has been emperically determined that these values are associated with good foam production. Thus, by now combining equation (1) and equation (4), one obtains the approximate amount of oxygen required for Fe oxidation as follows:

$$(5)\ O_{Fe}=2.71(\%FeO)[2.14(wt.\ Si)+2(2.14)(wt.\ Si)]/(100-\%\ FeO)$$

The value of $O_C$ in formula I is the volume of oxygen needed to oxidize carbon to CO and $CO_2$ and is approximately equal to 17.87(total C burned). The value 17.87 is the theoretical stoichiometric value to burn carbon to carbon monoxide and 10 percent carbon dioxide. The total C burned is in turn given by the formula (tot. C burned)= 0.01(Δ%C)(wt. of hot metal). The Δ%C is the amount of carbon burned during the desiliconization period, which is empirically determined to be from about 0.7 to about 1.0%, depending on the hot metal silicon content, lance height, hot metal to scrap ratio, vessel geometry and age.

The oxygen needed to oxidize manganese to MnO ($O_{Mn}$) is approximated by the relation $O_{Mn}$=3.54(total Mn burned). Since the manganese affinity for oxygen is less than that of Si, and the scrap is not completely melted in the early stages of the blow, Mn is not completely burned. Therefore, the total Mn burned is approximated at 50% of the total input Mn from the hot metal and scrap, such that the oxygen to oxidize Mn is equal to 3.54(0.5)(total wt. Mn input).

In the United States, the $O_{misc.}$ term, which is the oxygen needed to oxidize titanium, phosphorus and other trace elements, can be neglected since the values are insignificant due to the quality of the raw materials. However, in Europe and Japan, the $O_{misc.}$ term may not be ignored and, if necessary, values for this term can be empirically selected.

Based on the foregoing formula, the volume of oxygen to be blown to reach the peak decarburization period can be approximated. The complete duration of the blowing cycle is of course determined by modifying the terms in the formula for the amount of oxygen necessary to completely oxidize all of the various elements depending upon the aim carbon. All of the foregoing calculations may be done by computer and input into the system for precision control of the process as would be known to those of ordinary skill in the art in view of this disclosure.

From the calculated oxygen volume to reach peak decarburization, one can then modify any normally prescribed shop practice to implement the high lance, flow rate reduction practice to have the minimum flow rate correspond to the approximate beginning of the peak decarburization period.

Typical parameters used by BOF shops to dictate the prescribed starting height for a normal BOF cycle include the size of the heat, the amount of scrap, vessel size and configuration, lance specifications and the like. The initial lance height according to the invention will preferably be higher than normal shop specifications. In particular, the initial lance height is adjusted to produce a foamy slag during the initial stages of the blowing cycle. The actual starting height according to the invention will vary from shop to shop and must be determined empirically with the objective of producing enough foamy slag volume to produce a post-combustion heat transfer efficiency of greater than approximately 35 %, and more preferably at least about 65 % to 80% or greater. In the preferred practice the starting lance height is selected to be from approximately 5 to approximately 50, and more preferably from approximately 10 to approximately 45, inches above the prescribed practice for the shop prior to implementation of the inventive method. However, the optimum lance heights will be determined from shop to shop based on empirical observation as to the effectiveness of obtaining a foamy slag.

Most BOF shops reduce the lance height step-wise during the oxygen blowing cycle. In the preferred practice of the invention, each step in the decrease of the lance height is set to be higher than the lance height prescribed for each step by the normal shop specifications prior to implementation of the inventive method. This is to ensure the continued formation and maintenance of a foamy slag prior to the peak decarburization period. However, it is also important to maintain oxygen utilization efficiency and to prevent slopping. Accordingly, the increase in lance height over existing shop specifications is reduced for each step down. For example, in a shop using a six step lance height decrease, the step-wise reduction in lance height according to the inventive practice might proceed from 35 to 30 to 25 to 10, 10 and 0 inches above shop specifications, respectively. Thus, at the end of the blowing sequence, the lance height is preferably no different than the normal shop specification. The optimum lance heights for each step down will be determined from shop to shop based on empirical observation depending upon the amount of foamy slag produced and the ability of the vessel to contain it.

The rate of lance height reduction will also depend on the effectiveness of foam creation. If the lance is brought down too quickly, it will be difficult to maintain a foamy slag. Conversely, if the lance is brought down too slowly, premature slopping may occur and oxygen utilization efficiency may be lost. In the preferred embodiment, each successive step in the lance height reduction will be maintained for a progressively shorter duration up to the point of peak decarburization. To ensure good foam formation, the lance is preferably maintained at the initial height for the majority of the duration of the oxygen blow prior to peak decarburization. In a typical blowing sequence this will be from about 3 to about 5 minutes. Thus, in the preferred embodiment, approximately 40 to 60% of the calculated oxygen volume to reach peak decarburization will be blown while the lance is at the initial lance height. Progressively less oxygen volume will be blown with each successive reduction prior to the peak decarburization period, such that the duration of the lance at each height will be progressively shorter until it reaches the peak decarburization period. If one desires to bring the lance down continuously, then the rate at which the lance is brought down should be gradually accelerated so that the majority of the oxygen blown prior to peak decarburization will be blown in the early stages when the lance is at its higher positions. The duration of the blowing sequence during and after peak decarburization is also important because this is the critical period for bringing the steel chemistries up to normal specifications. Accordingly, once the peak decarburization period has commenced, or shortly thereafter, the lance should be at about the normal shop parameters for a given heat and remain their for a duration sufficient to normalize the steel chemistries.

As noted, the optimum parameters for initial lance height and rate of decrease must be determined empirically for each shop with the foregoing objectives in mind. Those of ordinary skill in the art will be able to optimize the lance heights for a given shop to practice the invention based on the instant disclosure.

In the preferred embodiment, the high lance and/or slow lance height reduction is coupled with a reduction in the oxygen flow rate up to the commencement of peak decarburization. The critical aspect of this coupling is that the oxygen flow rate is at its minimum at the commencement of the peak decarburization period and has been reduced low enough to control the foamy slag and prevent slopping. Surprisingly, it has been discovered that the oxygen flow rate can be reduced low enough to prevent slopping without critically effecting the oxygen utilization efficiency. Until the commencement of the peak decarburization period, when the oxygen flow rate will be at its minimum, one can select the oxygen flow rates, lance height and rate of lance height decrease to optimize the formation of foamy slag in a controlled manner. This is also determined empirically for each shop depending on the amount of foam produced and the ability of the particular vessel to contain it.

Although in the preferred embodiment each lance height reduction is accompanied by a reduction in the oxygen flow rate, those of ordinary skill in the art have a significant amount of latitude in determining the best practice for a given shop. The object, of course, is to produce enough foam to reach post-combustion heat transfer efficiency levels on the order of 60 to 80% or higher. The amount of foam necessary for this purpose can be estimated by the FeO content calculated at the commencement of the peak decarburization period. Typically the percent FeO in the slag at peak decarburization is on the order of approximately 10 to 14% in a normal blowing sequence. By contrast, the foam associated with the desired heat transfer levels according to the invention is on the order of about 14 to 20%, and more preferably 16 to 18% FeO. Accordingly, the step down in lance height and oxygen flow rate approaching the peak decarburization can be aimed to reach an FeO content favorable to foamy slag generation. To obtain an adequate amount of foamy slag, the initial oxygen flow rate is commenced at or only slightly below lance specifications.

At the commencement of the peak decarburization period, also the peak slopping period, it is important that the flow rate minimum be low enough to allow control of the foam. It has been discovered that this oxygen flow rate must be substantially lower than would be expected necessary to maintain an acceptable oxygen utilization efficiency. The optimum ability to controllably produce a large amount of foam is enabled by an oxygen flow rate decrease in the range of from approximately 15 to approximately 30% of the lance specification. Still more preferably, the minimum oxygen flow rate is about 20 to about 30% lower than lance specification. Still more preferably about 25 to 30%. Surprisingly, oxygen utilization efficiency is not effected.

The minimum oxygen flow rate used in the preferred embodiment is determined from the lance or nozzle specification. As is known in the art, for example as discussed in Chatterjee, *Iron and Steel,* pp 627–632 (December, 1972), and Chatterjee, *Iron and Steel,* pp 38–40 (February, 1973), incorporated herein by reference, oxygen lances and nozzles are designed for a specified oxygen flow rate, which typically corresponds to the theoretical optimum flow rate. For example, typical lances will have specifications ranging from 18,000 scfm to 29,000 scfm, depending on the lance. In the method of the invention, the preferred minimum oxygen flow rate for use at the commencement of the peak decarburization period is at least 15% lower than the lance specification or theoretical optimum flow rate. Still more preferably, from 20 to approximately 30% lower.

Once the oxygen blowing cycle has commenced, foamy slag is produced in the vessel and maintained as the lance is lowered. At or about the commencement of the peak decarburization period, the flow rate reduced to a minimum. This generates the maximum amount of foamy slag that can be controllably produced without slopping during the peak decarburization period, which in a typical melt lasts on the order of 3 to 5 minutes. To ensure that loss of oxygen utilization efficiency is minimized, the oxygen flow rate is increased again prior to the end of, or shortly after, the peak decarburization period. Preferably, the flow rate is increased to normal shop specifications, terminating with an oxygen flow rate at or near lance specifications. In the preferred practice, the flow rate increase at the end of the blowing sequence is also accompanied by one or more further decreases in the lance height, again corresponding preferably to normal shop operating parameters for this portion of the blowing sequence. This portion of the blowing sequence should have a duration effective to normalize the steel chemistries. In addition to salvaging the oxygen utilization efficiency and restoring the iron oxide content to the level of the normal blowing practice, this functions to kill the foam.

The practice of the foregoing method has resulted in both an increased post-combustion ratio of several percent and a significant increase in the post-combustion heat transfer efficiency. In a typical BOF practice, the post-combustion ratio, i.e., the percentage of CO burned to $CO_2$ is on the order of 8%, with 25% of the heat being recaptured by the bath. Due to the high lance practice of the invention, typically 10.5% or more of the CO is burned to $CO_2$ with 80% or greater of the heat being transferred to the bath. In a typical heat of 225 net tons (NT) this roughly corresponds to an increase of 10 million BTUs picked up by the bath from the normal practice. A typical 285 NT heat would gain roughly 13 milliom BTUs. In addition, scrap charge has been increased from 24% to 28%, resulting in a 5.5% increase in steel production. Still further, due to the improved phosphorus removal associated with the inventive practice, flux consumption has been reduced by 25%, with the elimination of spar usage entirely. This formerly averaged roughly 8.6 pounds per NT steel. Yet another advantage is that the large amount of foamy slag produced by the method coats the furnace refractory thereby extending the life of the furnace lining by 2,000 heats or more, and reduced iron dust generation. In a typical heat one can expect roughly 42 pounds Fe dust per NT, whereas with the practice of the invention dust is reduced to roughly 26 pounds per NT. These and other advantages and a better understanding of the invention will be appreciated from the following non-limiting example.

EXAMPLE

A 225 NT heat was charged to the BOF vessel. The capacity of the vessel when newly lined is 4639 cubic feet. This vessel had been used for 2000 heats. The hot metal (HM) weight was 350,000 lbs. and comprised of 0.70% silicon, 0.28% manganese, 0.006% sulfur, 0.064% phosphorus. The hot metal temperature was 2481° F. The charge also included 138,000 lbs. scrap, 12,000 lbs. burnt lime and 6,800 lbs. dolomitic lime, but did not require any fluorspar. The oxygen volume to reach an aim carbon content of 0.040% was calculated at 341,000 std. $ft^3$ for the oxygen blowing sequence. The approximate oxygen volume to reach the peak decarburization period for this charge was calculated as follows:

$$O_{Si} = 13.85(\text{wt. Si.}) = 13.85(0.01)(\%\ HM\ \text{Si})(\text{wt. } HM) \quad (1)$$
$$= 13.85(0.01)(0.70)(350{,}000)$$
$$= 33{,}933\ \text{ft}^3$$

$$O_{Fe} = 2.71(\text{wt. FeO}) = 2.71(0.01)(\%\ \text{FeO})(\text{wt. slag}) \quad (2)$$
$$= 2.71(0.01)(\%\ \text{FeO})\ [(\text{wt. } SiO_2) + (\text{wt. CaO})]/[(0.01)(100 - \%\ \text{FeO})]$$
$$= 2.71(\%\ \text{FeO})\ [2.14(\text{wt. Si}) + 2(2.14)(\text{wt. Si})]/(100 - \%\ \text{FeO})$$
$$= 2.71(\%\ \text{FeO})[2.14(0.01)(\%\ HM\ \text{Si})(\text{wt. } HM) + 2(2.14)(0.01)(\%\ HM\ \text{Si})(\text{wt. } HM)]/(100 - \%\ \text{FeO})$$
$$= 2.71(16)[2.14(0.01)(0.7)(350{,}000) + 2(2.14)(0.01)(0.70)(350{,}000)/(100 - 16)$$
$$= 8{,}119\ \text{ft}^3$$

$$O_C = 17.87(\text{tot. C burned}) \quad (3)$$
$$= 17.87(0.01)(\Delta\ \%\ \text{C})(\text{wt. } HM)$$
$$= 17.87(0.01)(0.95)(350{,}000)$$
$$= 59{,}418\ \text{ft}^3$$

$$O_{Mn} = 3.54(\text{tot. Mn burned}) \quad (4)$$
$$= 3.54(0.5)(\text{tot. Mn input})$$
$$= 3.54(0.5)[0.01(\%\ HM\ \text{Mn})(\text{wt. } HM) + 0.01(\%\ \text{scrap Mn})(\text{wt. scrap})]$$
$$= 3.54(0.5)[0.01(0.28)(350{,}000) + (0.01)(0.50)(138{,}000)]$$
$$= 2{,}956\ \text{ft}^3$$

therefore;

$$\text{Oxygen } (scf) = O_{Si} + O_{Fe} + O_C + O_{Mn}$$
$$= 33{,}933 + 8{,}119 + 59{,}418 + 2{,}956$$
$$= 104{,}426\ \text{ft}^3$$

From the foregoing calculation, the peak decarburization period for this heat should commence after approximately 104,426 cubic feet of oxygen is blown.

According to normal shop parameters for the described charge the lance would be adjusted to an initial height above the bath of 100 inches and the oxygen blowing cycle would be commenced with an oxygen flow rate of 20,000 scfm according to lance specifications. For the instant practice the lance was adjusted to 135 inches above the bath and the oxygen flow rate was commenced at 19,000 scfm. After 3.5 minutes approximately 66,500 cubic feet of oxygen was blown and the lance height was reduced to 110 inches and the oxygen flow rate was reduced to 18,000 scfm. This is to be contrasted with a lance height of 80 inches for the normal practice and no reduction in the flow rate. The lance height was next reduced to 90 inches after 5 minutes, and approximately 93,500 scf of oxygen had been blown, and the flow rate reduced to 16,000 scfm. In the normal practice the lance height would have been reduced to 65 inches and the flow rate unchanged.

After 5.7 minutes and approximately 104,000 cubic feet of oxygen was blown, the charge was almost at its peak decarburization period and the oxygen flow rate was reduced to 15,000 scfm, with a concomitant reduction in lance height to 75 inches, ten inches above normal practice. No deleterious slopping occurred.

After 10 minutes in the blowing cycle had elapsed the lance height was reduced again to 70 inches, as compared to 65 inches in the normal practice. The oxygen flow rate was increased to 17,500 scfm for two minutes until about 203,000 cubic feet of oxygen had been blown. Finally, after 12 minutes the lance height was reduced to 65 inches, in accordance with shop parameters, and the oxygen flow rate increased to the lance specification of 20,000 scfm for the balance of the blowing cycle of 18.9 minutes to blow the calculated oxygen volume of 341,000 standard cubic feet.

The foregoing blowing practice created a foamy slag in the BOF vessel that did not slop, and resulted in a post-combustion heat transfer efficiency of approximately 80% and a post-combustion ratio of 10.7%.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. A method of improving post-combustion heat recovery in a vessel containing a charge of molten ferrous metal and slag, and including a lance for the introduction of oxygen gas into said charge, said method comprising:

a) approximating the volume of oxygen to be blown to reach the starting point of a peak decarburization period for said charge;

b) positioning said lance to a height above said charge adapted to enable said oxygen to react with said charge to form FeO in said slag in an amount effective to render said slag of a foamy consistency and to induce post combustion;

c) blowing said oxygen on said charge at an initial oxygen flow rate effective to produce a foamy slag; and, d) decreasing the height of said lance and reducing said oxygen flow rate to produce said foamy slag in an amount effective to obtain a post-combustion heat transfer efficiency of at least about 35% without slopping, said oxygen flow rate being reduced to a minimum at about said starting point of said peak decarburization period.

2. The method according to claim 1 wherein said lance has a specified optimum oxygen flow rate and said minimum oxygen flow rate is about 15 to about 30% lower than said lance specification for oxygen flow rate.

3. The method according to claim 1 wherein said lance has a specified optimum oxygen flow rate and said minimum oxygen flow rate is about 20 to about 30% lower than said lance specification for oxygen flow rate.

4. The method according to claim 1 wherein said foamy slag is produce in an amount effective to produce a heat transfer efficiency of at least about 60%.

5. The method according to claim 1 wherein the height of said lance and the oxygen flow rate are first reduced after about 40 to about 60% of said oxygen volume required to reach said peak decarburization period is blown.

6. The method according to claim 1 further comprising increasing said oxygen flow rate prior to the end of said peak decarburization period.

7. The method according to claim I wherein said lance has a specified optimum oxygen flow rate and after said peak decarburization has commenced, the oxygen flow rate is increased to about said lance specification.

8. The method according to claim 1 wherein said FeO in said foamy slag is from about 14 to about 20% by weight based on the weight of said slag at said starting point of said peak decarburization period.

9. The method according to claim 1 wherein said FeO in said foamy slag is at least about 16% by weight based on the weight of said slag at said starting point of said peak decarburization period.

10. A method of improving the post-combustion heat recovery of an oxygen blowing sequence for a basic oxygen furnace having a lance for the introduction of oxygen gas into a charge of molten ferrous metal, said sequence having a specified initial lance height and said lance having a specified optimum oxygen flow rate, said method comprising:

a) approximating the volume of oxygen to be blown to reach the starting point of a peak decarburization period for said charge;

b) positioning said lance at an initial lance height above said specified initial lance height;

c) blowing said oxygen on said charge at an initial oxygen flow rate effective to generate a foamy slag and to induce post combustion; and, d) reducing said lance height and reducing said oxygen flow rate, said flow rate being reduced by at least about 15% from said specified oxygen flow rate at about said starting point of said peak decarburization period.

11. The method according to claim 10 wherein said initial lance height is from about 5 to about 45 inches above said specified initial lance height.

12. The method according to claim 10 wherein said oxygen flow rate is reduced by about 20 to about 30% from said specified oxygen flow rate.

13. The method according to claim 10 wherein about 40 to about 60% of the oxygen volume required to reach said starting point of said peak decarburization period is blown when said lance is at said initial lance height above said specified initial lance height.

* * * * *